US009089736B2

(12) United States Patent
Draper et al.

(10) Patent No.: US 9,089,736 B2
(45) Date of Patent: Jul. 28, 2015

(54) PROGRAMMABLE SYSTEM AND PROCESS FOR MONITORED AND ASSISTED WEIGHT LIFTING DURING REHABILITATION OR TRAINING EXERCISE

(71) Applicants: Michael Draper, Jacksonville, FL (US); Johnnie Paulus, Glen St. Mary, FL (US)

(72) Inventors: Michael Draper, Jacksonville, FL (US); Johnnie Paulus, Glen St. Mary, FL (US)

(73) Assignee: XCENTRIC TECHNOLOGIES, LLC, Jacksonville, FL (US)

( * ) Notice: Subject to any disclaimer, the term of this patent is extended or adjusted under 35 U.S.C. 154(b) by 201 days.

(21) Appl. No.: 13/833,833

(22) Filed: Mar. 15, 2013

(65) Prior Publication Data

US 2014/0274566 A1 Sep. 18, 2014

(51) Int. Cl.
*A63B 24/00* (2006.01)

(52) U.S. Cl.
CPC ..... *A63B 24/0062* (2013.01)

(58) Field of Classification Search
CPC ..... A63B 24/00
USPC ..... 482/1–9, 92, 97, 110–112, 900–902
See application file for complete search history.

(56) References Cited

U.S. PATENT DOCUMENTS

| | | | | |
|---|---|---|---|---|
| 3,998,100 | A | 12/1976 | Pizatella et al. | |
| 4,921,244 | A | 5/1990 | Berroth | |
| 5,314,394 | A | 5/1994 | Ronan | |
| 5,328,429 | A | 7/1994 | Potash et al. | |
| 5,407,403 | A | 4/1995 | Coleman | |
| 5,435,798 | A | 7/1995 | Habing et al. | |
| 5,476,428 | A * | 12/1995 | Potash et al. | 482/5 |
| 5,569,120 | A * | 10/1996 | Anjanappa et al. | 482/4 |
| 6,261,205 | B1 | 7/2001 | Elefson | |
| 6,565,491 | B1 * | 5/2003 | Thompson et al. | 482/110 |
| 6,632,159 | B1 | 10/2003 | Slattery | |
| 7,163,488 | B2 | 1/2007 | Anders et al. | |
| 7,470,216 | B2 * | 12/2008 | Farinelli et al. | 482/3 |
| 7,578,774 | B1 * | 8/2009 | Zetterberg | 482/112 |
| 7,666,118 | B1 * | 2/2010 | Anthony | 482/8 |
| 7,963,886 | B1 | 6/2011 | Schwinn et al. | |
| 8,105,206 | B2 * | 1/2012 | Rindfleisch | 482/6 |
| 2008/0076643 | A1 * | 3/2008 | Sencil | 482/97 |
| 2010/0298097 | A1 * | 11/2010 | Preumont et al. | 482/5 |
| 2012/0190502 | A1 * | 7/2012 | Paulus et al. | 482/5 |

* cited by examiner

*Primary Examiner* — Glenn Richman
(74) *Attorney, Agent, or Firm* — Thomas C. Saitta

(57) ABSTRACT

A system and process that selectively provides lifting assistance during the concentric phase and possibly during the eccentric phase during lifting of weights for rehabilitation or training, the system being programmable to provide a variety of exercise programs dedicated to a particular user, and the system monitoring the progress of the user during the exercise to selectively respond to certain trigger conditions.

25 Claims, 4 Drawing Sheets

PROGRAMMABLE SYSTEM AND PROCESS FOR MONITORED AND ASSISTED WEIGHT LIFTING DURING REHABILITATION OR TRAINING EXERCISE

BACKGROUND OF THE INVENTION

This invention relates generally to systems and processes for assisted or monitored weight lifting during rehabilitation or training exercise, and more particularly relates to such systems and processes utilizing weight lifting equipment comprising free weights or stacked weight plates raised and lowered during the exercise operation, the amount of weight being selectable by the user.

Rehabilitating weakened muscles or increasing muscle mass for health or athletic reasons through weight lifting is well known, and typically involves the use of free weights, weight machines utilizing stacked weight plates, or resistance or tension bands made of an elastic material. Free weights typically involve weight plates mounted onto the ends of a bar. Weight machines having stacked weight plates usually comprise a vertically elongated frame having an upper pulley through which a cable is suspended down to a weight mounting assembly comprising a descending rod member. The weight plates are stacked in flat layers and each plate is provided with a central opening through which the rod member extends in the neutral status. The weight plates and the rod member are provided with coordinating apertures through which a removable pin member is horizontally inserted, the location of the pin member determining the total number of weight plates to lifted during the weight lifting exercise. The other end of the cable, which may pass through additional pulleys, is attached to a handle or other gripping device, or is attached to a movable member of a user receiving structure, such as a bench, seat or the like upon which the user sits or lies during the weight lifting operation. Such user receiving structures may be dedicated to particular exercise or working particular muscle groups, such as for example leg lifts, leg curls, bench presses, arm curls, etc.

The weight lifting operation is divided into a concentric phase and an eccentric phase. In the concentric phase the weights are being lifted or raised, and during the eccentric phase the weights are being lowered. Rehabilitation and training exercise programs typically include sets and repetitions of a single exercise, wherein the user performs the same exercise, such as for example a leg curl, for multiple repetitions, the number of repetitions and the weight amount being chosen such that the exercise becomes increasingly difficult over the course of the repetitions due to muscle fatigue, which in turn causes muscle development.

It is known that rehabilitation of muscles and increase in muscle mass can be more quickly achieved if some lifting assistance is provided during the concentric phase of the latter repetitions in a set. This may be accomplished by assistance from another person or through mechanical systems that have been developed. Likewise, it is also sometimes useful from a safety, rehabilitation or training viewpoint to provide some assistance during the eccentric phase.

It is an object of this invention to provide a system and a process that improves and is distinct from the known systems and processes utilized in assisting and/or monitoring weight lifting during rehabilitation or training exercises performed with free weights or stacked plate weight machines. This and other objects, as will be made clear from the discussion to follow, will be accomplished by providing a system and process that selectively provides lifting assistance during the concentric phase and possibly during the eccentric phase, that is programmable to provide a variety of exercise programs dedicated to a particular user, and that monitors the progress of the user during the exercise selectively respond to certain conditions or triggers.

SUMMARY OF THE INVENTION

In general the invention comprises embodiments of a programmable system and process for monitoring and assisting weight lifting during rehabilitation of training exercise that is utilized with or comprises free weights or a stacked plate weight machine. The system comprises in general a support structure, a cable affixed to a drum pulley operated by a motor, the cable being attached to the bar of the free weights or to the cable or weight mounting assembly of the weight machine, whereby controlled rotation of the drum pulley results in lifting or lowering assistance to the weights during the concentric or eccentric phases of the exercise. A control panel with input means and display means controls a programmable computer to monitor and control the mechanical operative components. The system determines the exercise parameters for a particular user, controls the assistance program for the particular user, and monitors the exercise to determine when responsive assistance is needed, among other purposes.

The process comprises in general the steps of selecting the appropriate weight for the exercise and inputting this value through the control panel, determining and inputting via the control panel, if not automatically calculated by the processor, the user range of motion, repetition speed and assistance percentage variables, monitoring the exercise operation upon commencement, providing the pre-determined or calculated assistance percentage during the concentric exercise phase and/or providing processor controlled assistance percentage in response to sensed trigger conditions, and providing no assistance during the eccentric exercise phase unless certain trigger conditions are sensed.

DETAILED DESCRIPTION OF THE INVENTION

With reference to the drawings, the invention will be described in detail for its various embodiments. In general the invention comprises embodiments of a programmable system and process for monitoring and assisting weight lifting during rehabilitation of training exercise that is utilized with or comprises free weights or a stacked plate weight machine, which shall be referred to herein as the weight apparatus. The system comprises in general a support structure, a cable affixed to a drum pulley operated by a motor, the cable being attached to bar of the free weights or the cable or weight mounting assembly of the weight machine, whereby controlled rotation of the drum pulley results in lifting or lowering assistance to the weights during the concentric or eccentric phases of the exercise. A control panel with input means and display means controls a programmable computer to monitor and control the mechanical operative components. The system determines the exercise parameters for a particular user, controls the assistance program for the particular user, and monitors the exercise to determine when responsive assistance is needed, among other purposes.

Figure 2:
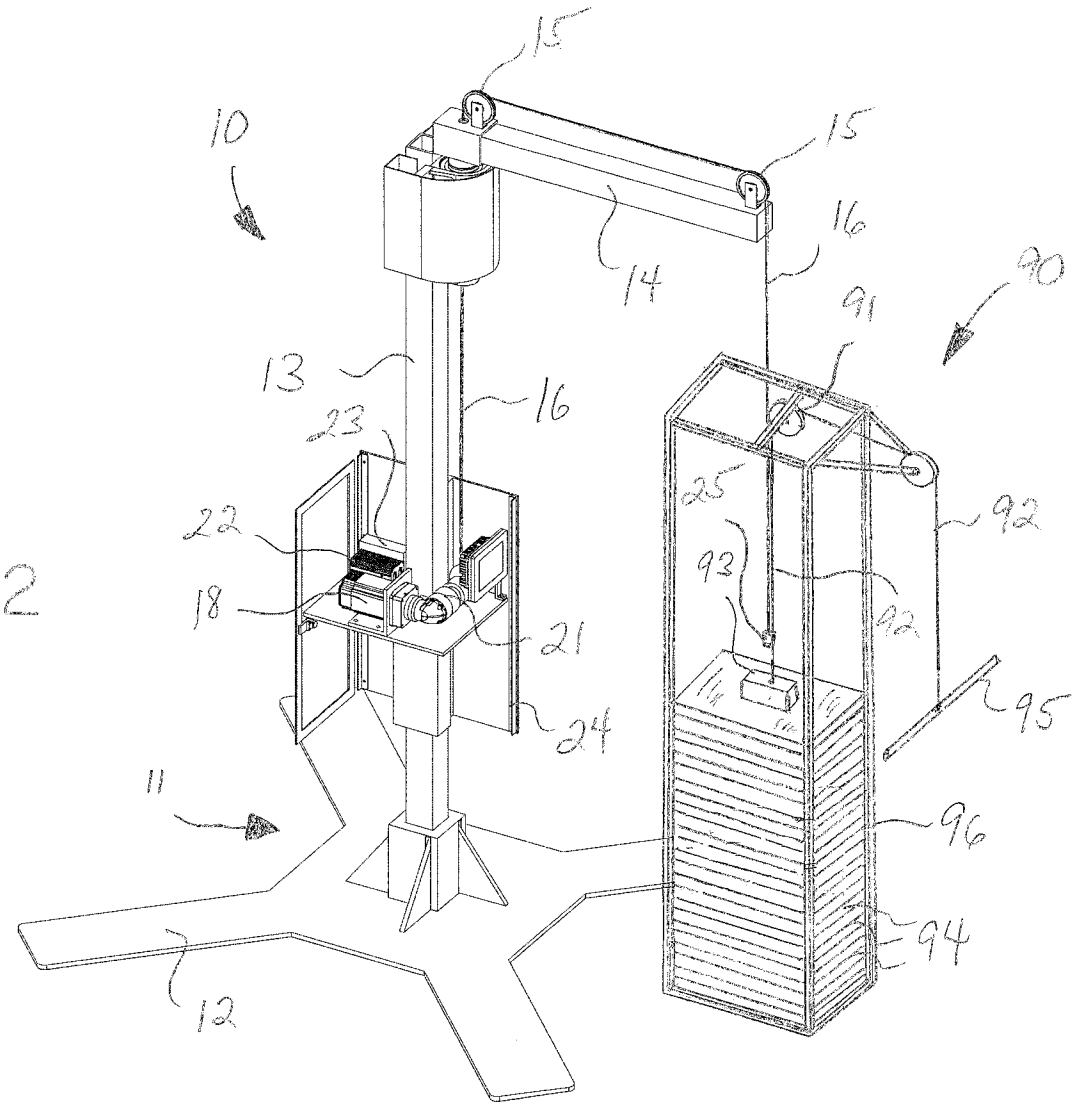
FIG. 2 a view of an embodiment of the system of the invention in conjunction with a weight apparatus.

As shown in the drawings, with particular reference to FIG. 2, an embodiment of the system 10 of the invention comprises a support structure 11 comprising a base 12, and vertical post 13 and a boom arm 14. One or more pulleys 15 are mounted on the boom arm 14, the pulleys 15 being adapted to receive a cable 16 such that a portion of the cable 16 extends downward adjacent the post 13 and a portion of the cable 16 extends downward from a point farther out on the boom arm 14. The boom arm 14 may be mounted on the post 13 in a manner that allows the boom arm 14 to be pivoted about the vertical axis of the post 13, the post 13 may be mounted on the base 12 such that the post 13 and boom arm 14 may be pivoted about the vertical axis of the post 13, or the base 13 may be provided with wheels, rollers or the like that allow the support structure 11 to be moved or rotated. The elements of the support structure 11, the cable 16 and other elements of the system are constructed of suitably strong material such that weights totaling hundreds of pounds may be lifted and lowered in a manner described below.

Figure 3:
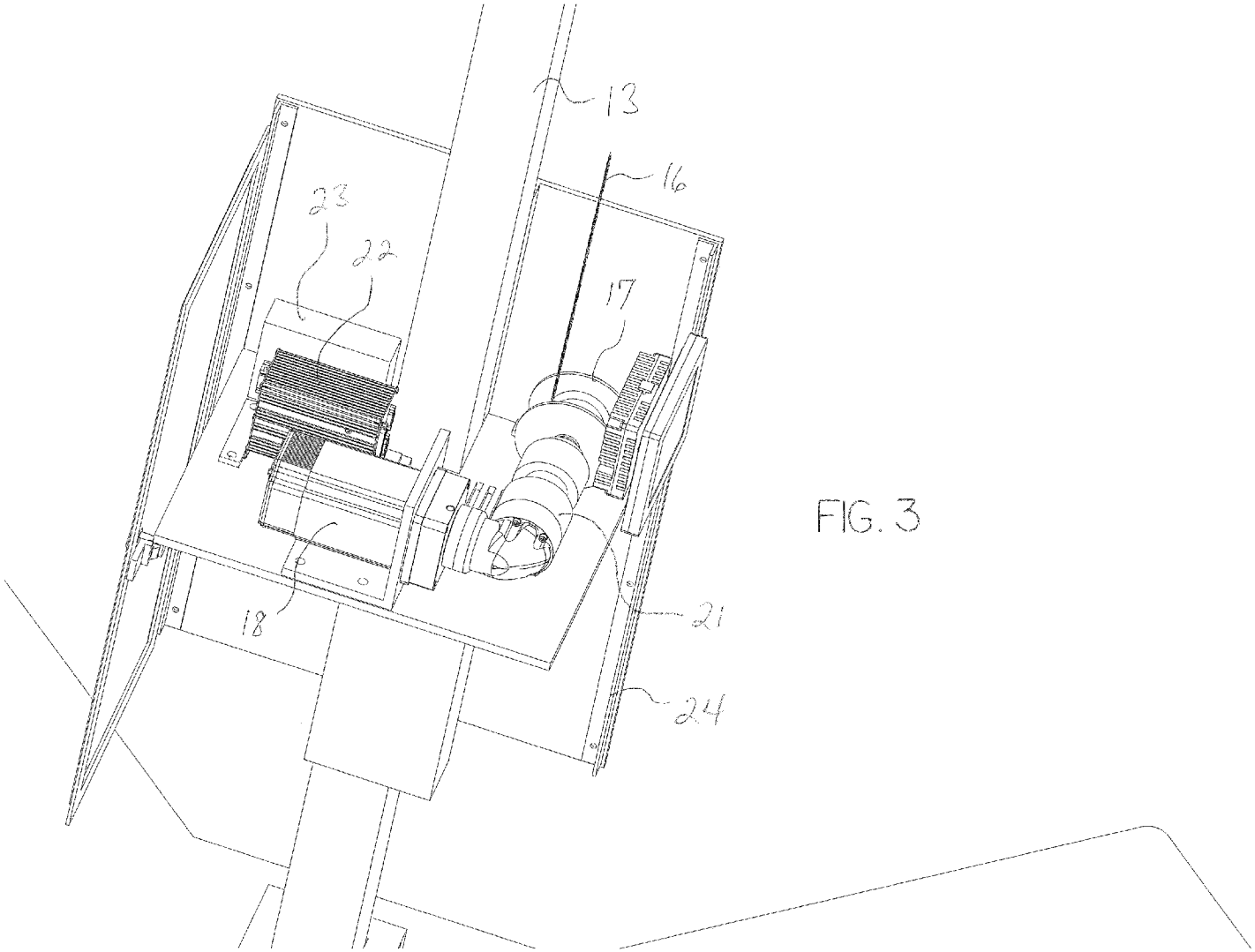
FIG. 3 is a partial view of an embodiment of the system showing a direct drive assembly.
Figure 4:
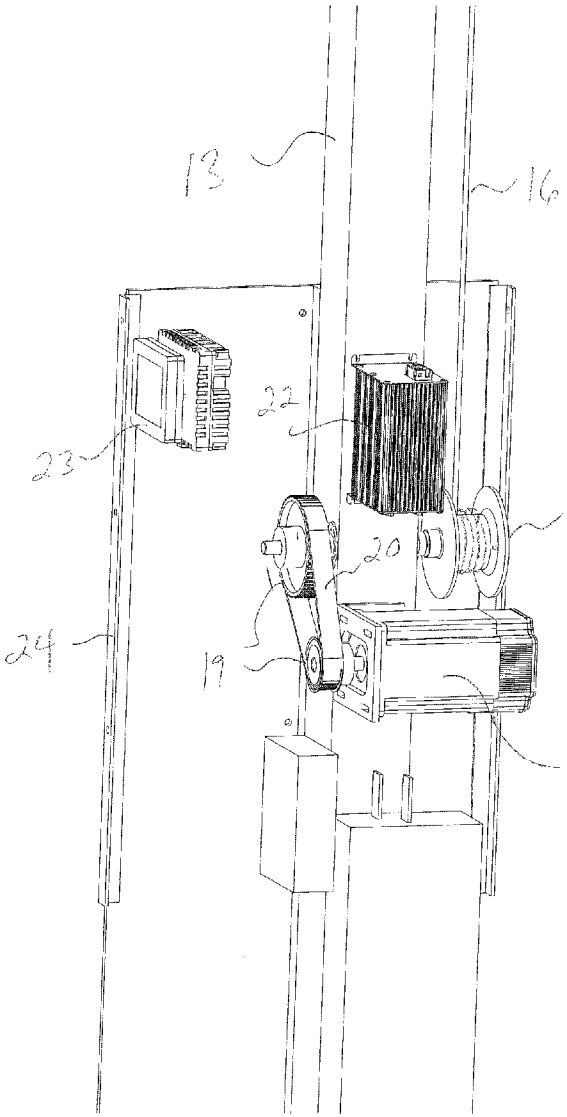
FIG. 4 is a partial view of an embodiment of the system showing a toothed belt and gear assembly.

The cable 16 is attached to a drum pulley 17 mounted onto the post 13 of the support structure 11, the drum pulley 17 having a generally horizontal axis of rotation such that rotation of the drum pulley 17 retracts or extends cable 16. Rotation of the drum pulley 17 is achieved by motor 18, which preferably is an electric servo motor, the motor 18 being operatively connected to the drum pulley 17 using gears 19 and a toothed belt 20, as shown in FIG. 4, a direct drive assembly 21, as shown in FIG. 3, a common shaft (not shown), or other suitable operative mechanisms. A computer processor 22 monitors and controls the operation of the motor 18, the computer processor 22 being controlled by a control and display panel 23. The control and display panel 23 allows data input into the computer processor 22 and the display of data sensed, determined or calculated by the system. Preferably a housing or cabinet 24 is provided to enclose these components of the system 10, the cable 16 extending through an opening in the housing 24.

The system 10 as described operates in conjunction with a weight apparatus, either free weights or a stacked plate weight machine 90 of known structure comprising a vertically elongated frame 96 having an upper pulley 91 through which a cable 92 is suspended down to a weight mounting assembly 93 comprising a descending rod member. The weight plates 94 are stacked in flat layers and each plate 94 is provided with a central opening through which the rod member extends in the neutral or non-operative status. The weight plates 94 and the rod member are provided with coordinating apertures through which a removable pin member is horizontally inserted, the location of the pin member determining the total number of weight plates 94 to lifted during the weight lifting exercise. The other end of the cable 92, which may pass through additional pulleys, is attached to a handle or other gripping device 95, or is attached to a movable member of a user receiving structure, such as a bench, seat or the like upon which the user sits or lies during the weight lifting operation.

In a preferred embodiment, the system 10 is structurally separate from the weight machine 90 and the cable 16 is detachably connected to the cable 92 or weight mounting assembly 93 of the weight machine 90 using a quick release cable attachment member 25, such as a clamp or other mechanical structure, such that the cable 16 can be easily and quickly attached and detached. Alternatively, the system 10 may be connected to the weight machine 90 by permanent attachment of the cable 16 or by structurally connecting the support structure 11. Still further in another embodiment, the operative components of the system 10 may be directly mounted onto the frame 96 of the weight machine 10. For free weight applications, the cable 16 is attached to the bar of the free weights. In this manner, when motor 18 is activated to turn drum pulley 17 the cable 16 is retracted, thereby providing a lifting force to the weights during the concentric phase. When the weights are lowered in the eccentric phase, the drum pulley is rotated in the opposite direction to extend the cable 16.

Figure 1:
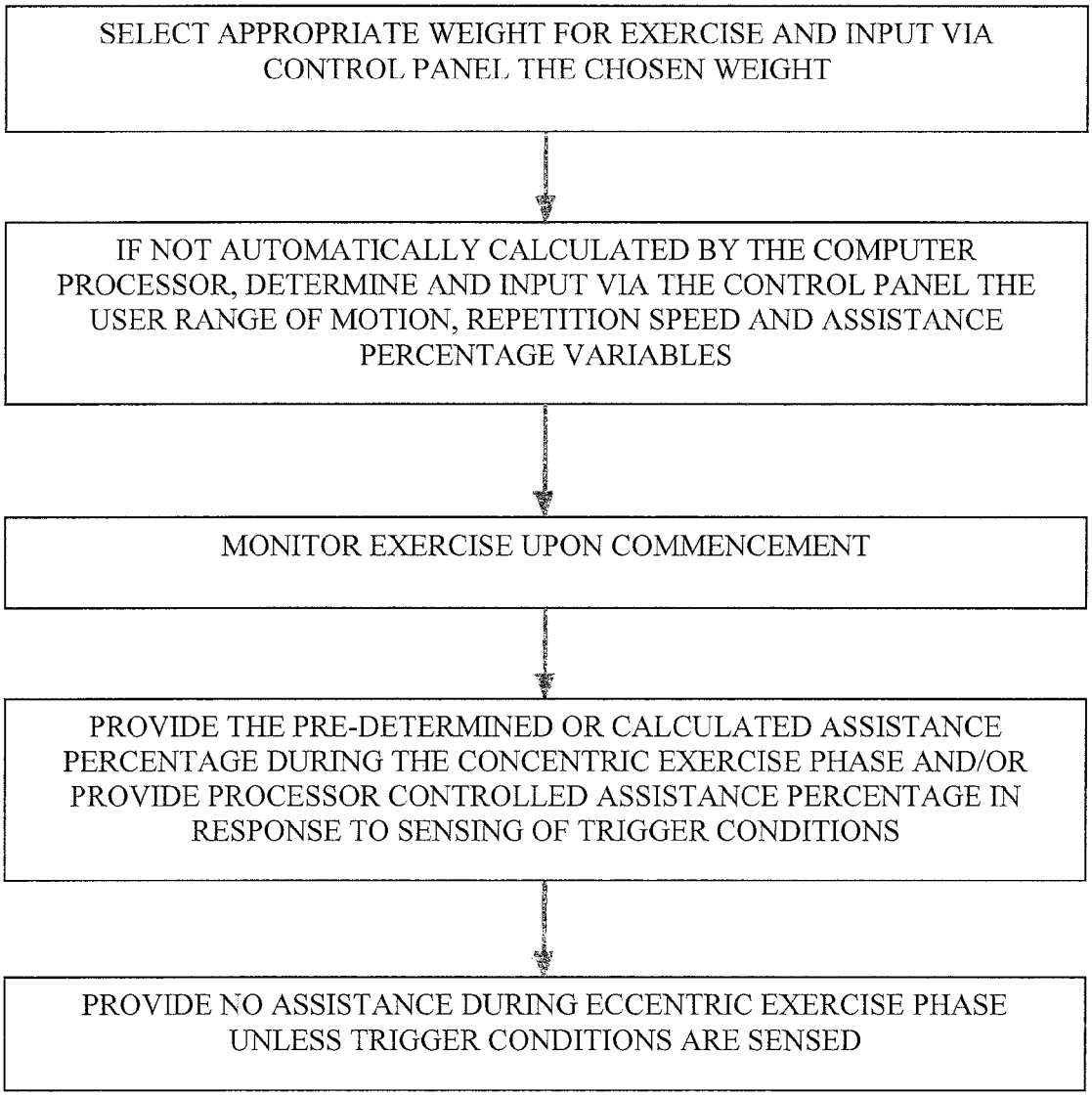
FIG. 1 is a flow chart representation of embodiments of the process.

The system 10 as described above is adapted to conduct a computer assisted process of monitoring and assisting weight lifting during rehabilitative and training exercise, whereby the beneficial effects of the exercise are increased and desired results are achieved more rapidly and with greater safety. As shown in the FIG. 1 flowchart, the process generally comprises the basic steps of selecting the appropriate weight for the exercise and inputting this value through the control panel, determining and inputting via the control panel 23 (if not automatically calculated by the processor 22) the user range of motion, repetition speed and weight lifting assistance percentage variables, monitoring the exercise operation upon commencement, providing the pre-determined or calculated weight lifting assistance percentage during the concentric exercise phase and/or providing processor controlled weight lifting assistance percentage in response to sensed trigger conditions, and providing no weight lifting assistance during the eccentric exercise phase unless certain trigger conditions are sensed.

The weight chosen for a given exercise may be the maximum weight the user can lift unassisted or may be a lesser weight when an increase in repetitions for a given exercise set is desired or during rehabilitation exercise when a muscle is injured. The user range of motion for a given exercise and chosen weight is the distance from start to finish of one exercise stroke and the repetition speed is the rate at which the user lifts and lowers the weights. These parameters determine the start point, the transition point where the concentric phase (lifting the weights) changes to the eccentric phase (lowering the weights), and the finish point. Some or all of these parameters may be sensed, calculated and utilized by the processor 22 based on detection of movement and torsion of the motor 18 and/or drum pulley 17 during the exercise strokes using known sensing devices. Alternatively, some or all of these parameters may be manually measured, calculated, noted on the computer control panel and display panel 23, and/or entered into the processor 22 via the computer control and display panel 23.

In the basic embodiment of the process, the desired assistance percentage for assistance during the concentric phase is input into the processor 22. The assistance percentage is the amount of lifting force provided by the system 10 which thereby decreases the effective amount of weight being lifted by the user. For example, an assistance percentage of 25% may be applied to a selected weight of 200 pounds, meaning that the system provides 50 pounds of lifting assistance such that the user is only lifting the equivalent of 150 pounds. Once the weight is lifted to the transition point, the assistance is removed and the user lowers the full weight of 200 pounds during the eccentric phase.

More commonly the assistance percentage will be selected to vary during the set of repetitions. For example, for a set or twelve repetitions, no assistance may be provided for the first eight repetitions and an assistance percentage of 25% may be applied to the last four repetitions. Alternatively, an assistance percentage of 25% may be applied to the first four repetitions, an assistance percentage of 37.5% may be applied to the next four repetitions, and an assistance percentage of 50% may be applied to the last four repetitions. Still otherwise, the assistance percentage could be increased for each repetition, could decrease for each repetition, could be alternatingly increased and decreased, etc. The assistance percentage may also vary during a given concentric stroke, such that a lesser percentage may be applied at the beginning and end of the stroke and a greater percentage applied during the middle of the stroke.

In most exercise circumstances it is desirable that the effective weight be greater during the eccentric phase than during the concentric phase, meaning in this process no assistance, i.e., lifting force, is provided during the lowering of the weight. Thus, for a 200 pound total weight receiving 25% assistance during the concentric phase to reduce the effective exercise weight to 150 pounds, the user will be lowering the full 200 pounds during the eccentric phase. Thus, once the system 10 senses that the transition point has been reached, i.e., that the concentric stroke has been completed, the lifting assistance is aborted and the motor 18 is reversed to extend the cable. When the system 10 senses that the finish point of the eccentric stroke has been reached and concentric has begun, the lifting assistance is again commenced.

The system 10 and process may also be provided with known sensor mechanisms to sense certain trigger conditions that may occur during either the concentric or eccentric phases. Trigger conditions may include a concentric or eccentric stroke that is occurring too fast or too slow, or a stoppage during the concentric or eccentric stroke. Upon occurrence of a trigger condition, a visible or audible alarm may be provided. Occurrence of a trigger condition may also initiate a response from the processor 22. For example, if the concentric stroke slows beyond an acceptable range based on the initially determined repetition speed, the assistance percentage may be automatically increased by the processor 22 such that the weights 94 can be raised to the transition point. Alternatively if the concentric stroke stops and the user begins to lower the weights 94, or if the rate during the eccentric stroke increases excessively due to the user being unable to sustain the total weight in a safe manner, lifting assistance may be applied to lighten the effective weight being lowered by the user to prevent injury or the weights 94 crashing onto the weight stack.

It is understood that equivalents and substitutions for certain elements set forth above may be obvious to those of skill in the art, and therefore the true scope and definition of the invention is to be as set forth in the following claims.

We claim:

1. A rehabilitation and training weight lifting assistance process comprising the steps of:

providing a weight-adjustable weight apparatus having a concentric weight lifting phase and an eccentric weight lifting phase;

providing a computer controlled weight lifting assistance system operably connected to said weight apparatus;

selecting a weight to be lifted by a user in a selected exercise comprising weight lifting repetitions;

determining a range of motion and a repetition speed of the user during the selected exercise;

determining a weight lifting assistance percentage to be provided to the user during the selected exercise;

monitoring the selected exercise upon commencement by sensing a trigger condition during said concentric phase;

providing the weight lifting assistance percentage during the concentric phase of the selected exercise and increasing the weight lifting assistance percentage during said concentric phase in response to sensing said concentric phase trigger condition such that the effective weight of said selected weight is reduced, while providing no weight lifting assistance percentage during the eccentric phase of the selected exercise.

2. The process of claim 1, wherein said step of determining a range of motion and a repetition speed of the user during the selected exercise is performed automatically by the computer controlled weight lifting assistance system.

3. The process of claim 2, wherein said step of determining a weight lifting assistance percentage to be provided to the user during the selected exercise is performed automatically by the computer controlled weight lifting assistance system.

4. The process of claim 1, wherein said step of determining a weight lifting assistance percentage to be provided to the user during the selected exercise comprises determining a weight lifting assistance percentage for each weight lifting repetition.

5. The process of claim 1, wherein said step of determining a weight lifting assistance percentage for each weight lifting repetition comprises choosing at least two different weight lifting assistance percentages.

6. The process of claim 1, wherein said concentric phase trigger condition comprises a slowing or stopping of movement during the concentric phase.

7. The process of claim 1, wherein said step of providing a computer controlled weight lifting assistance system comprises providing a computer controlled weight lifting assistance system comprising a cable attached to said weight adjustable weight apparatus, said cable mounted onto a drum pulley rotated by a motor, said motor being operably controlled by a computer processor controlled by a control and display panel.

8. The process of claim 7, wherein said cable is removably attached to said weight adjustable weight apparatus.

9. The process of claim 8, wherein said weight lifting assistance system further comprises a rotatable boom arm, and wherein said cable is suspended from said boom arm.

10. A rehabilitation and training weight lifting assistance process comprising the steps of:

providing a weight-adjustable weight apparatus having a concentric weight lifting phase and an eccentric weight lifting phase;

providing a computer controlled weight lifting assistance system operably connected to said weight apparatus;

selecting a weight to be lifted by a user in a selected exercise comprising weight lifting repetitions;

determining a range of motion and a repetition speed of the user during the selected exercise;

determining a weight lifting assistance percentage to be provided to the user during the selected exercise during the eccentric weight lifting phase;

monitoring the selected exercise upon commencement by sensing a trigger condition during said eccentric phase; and providing the weight lifting assistance percentage during the eccentric phase of the selected exercise and increasing the weight lifting assistance percentage during said eccentric phase in response to sensing said eccentric phase trigger condition such that the effective weight of said selected weight is reduced.

11. The process of claim 10, wherein said eccentric phase trigger condition comprises an increase or stopping of movement during the eccentric phase.

12. The process of claim 10, wherein said step of determining a range of motion and a repetition speed of the user during the selected exercise is performed automatically by the computer controlled weight lifting assistance system.

13. The process of claim 12, wherein said step of determining a weight lifting assistance percentage to be provided to the user during the selected exercise is performed automatically by the computer controlled weight lifting assistance system.

14. The process of claim 10, wherein said step of determining a weight lifting assistance percentage to be provided to the user during the selected exercise comprises determining a weight lifting assistance percentage for each weight lifting repetition.

15. The process of claim 10, wherein said step of determining a weight lifting assistance percentage for each weight lifting repetition comprises choosing at least two different weight lifting assistance percentages.

16. The process of claim 10, wherein said step of providing a computer controlled weight lifting assistance system comprises providing a computer controlled weight lifting assistance system comprising a cable attached to said weight adjustable weight apparatus, said cable mounted onto a drum pulley rotated by a motor, said motor being operably controlled by a computer processor controlled by a control and display panel.

17. The process of claim 16, wherein said cable is removably attached to said weight adjustable weight apparatus.

18. The process of claim 17, wherein said weight lifting assistance system further comprises a rotatable boom arm, and wherein said cable is suspended from said boom arm.

19. A rehabilitation and training weight lifting assistance process comprising the steps of:

providing a weight-adjustable weight apparatus having a concentric weight lifting phase and an eccentric weight lifting phase;

providing a computer controlled weight lifting assistance system operably connected to said weight apparatus;

selecting a weight to be lifted by a user in a selected exercise comprising weight lifting repetitions;

determining a range of motion and a repetition speed of the user during the selected exercise;

determining at least two different weight lifting assistance percentages to be provided at different times to the user during the selected exercise;

monitoring the selected exercise upon commencement comprising sensing a trigger condition during said concentric phase and sensing a trigger condition during said eccentric phase, wherein said concentric phase trigger condition comprises a slowing or stopping of movement during the concentric phase and wherein said eccentric phase trigger condition comprises an increase or stopping of movement during the eccentric phase;

providing the weight lifting assistance percentage during the concentric phase of the selected exercise such that the effective weight of said selected weight is reduced, while providing no weight lifting assistance percentage during the eccentric phase of the selected exercise;

said process further comprising the steps of increasing the weight lifting assistance percentage during said concentric phase in response to sensing said concentric phase trigger condition and applying a weight lifting assistance percentage during said eccentric phase in response to sensing said eccentric phase trigger condition.

20. The process of claim 19, wherein said step of determining a range of motion and a repetition speed of the user during the selected exercise is performed automatically by the computer controlled weight lifting assistance system.

21. The process of claim 20, wherein said step of determining a weight lifting assistance percentage to be provided to the user during the selected exercise is performed automatically by the computer controlled weight lifting assistance system.

22. The process of claim 19, wherein said step of determining a weight lifting assistance percentage to be provided to the user during the selected exercise comprises determining a weight lifting assistance percentage for each weight lifting repetition.

23. The process of claim 19, wherein said step of providing a computer controlled weight lifting assistance system comprises providing a computer controlled weight lifting assistance system comprising a cable attached to said weight adjustable weight apparatus, said cable mounted onto a drum pulley rotated by a motor, said motor being operably controlled by a computer processor controlled by a control and display panel.

24. The process of claim 23, wherein said cable is removably attached to said weight adjustable weight apparatus.

25. The process of claim 24, wherein said weight lifting assistance system further comprises a rotatable boom arm, and wherein said cable is suspended from said boom arm.

* * * * *